US007362876B2

(12) United States Patent
Tsai

(10) Patent No.: US 7,362,876 B2
(45) Date of Patent: Apr. 22, 2008

(54) INTERFERENCE-FREE TRANSMITTING RECEIVING EARSET

(76) Inventor: Jin-Chou Tsai, 18/F, No. 95, Roosevelt Rd., Sec. 2, Taipei City (TW)

( * ) Notice: Subject to any disclaimer, the term of this patent is extended or adjusted under 35 U.S.C. 154(b) by 774 days.

(21) Appl. No.: 10/949,308

(22) Filed: Sep. 27, 2004

(65) Prior Publication Data

US 2006/0067555 A1 Mar. 30, 2006

(51) Int. Cl.
*H04R 25/00* (2006.01)

(52) U.S. Cl. ..... 381/380; 381/370; 381/384

(58) Field of Classification Search ..... 381/317–318, 381/94.1–95, 370–384; 379/430
See application file for complete search history.

(56) References Cited

U.S. PATENT DOCUMENTS 6,181,801 B1 * 1/2001 Puthuff et al. ..... 381/380
6,411,722 B1 * 6/2002 Wolf ..... 381/371
6,683,965 B1 * 1/2004 Sapiejewski ..... 381/380

* cited by examiner

*Primary Examiner*—Suhan Ni
(74) *Attorney, Agent, or Firm*—Rosenberg, Klein & Lee

(57) ABSTRACT

A interference-free transmitting receiving earset includes a housing houses a speaker, a grille covering the speaker and having a front center tube, and two microphones mounted in the center tube of the grille in reversed directions to pick up sound waves from the user's external auditory canal and wound waves from the speaker respectively and to eliminate interference of sound waves from the speaker with sound waves produced by the user in the external auditory canal.

8 Claims, 10 Drawing Sheets

INTERFERENCE-FREE TRANSMITTING RECEIVING EARSET

BACKGROUND OF THE INVENTION

1. Field of the Invention

The present invention relates to a transmitting receiving earset and more particularly, to an interference-free transmitting receiving earset 2. Description of the Related Art FIG. 13 shows a conventional transmitting receiving earset 5 for use with a cellular telephone B. According to this design, the transmitting receiving earset 5 comprises a speaker 51 and a microphone 52. According to this design, the microphone 52 is kept at a distance away from the speaker 51. During communication, the microphone 52 picks up the user's voice and the surrounding noises, lowering the communication quality.

FIG. 14 shows an earset for wireless communication according to the prior art. According to this design, the earset 6 comprises an elongated housing 61, a speaker 62 installed in one end of the housing 61, a microphone 63 installed in the other end of the housing 61, and an ear hook 64 connected to the housing 61 for securing the housing 61 to the user's ear. This design of earset 6 cannot eliminate interference of external noises.

U.S. Pat. No. 5,909,498 discloses a transducer device, which includes a pair of transducers in the form of a speaker element and a microphone element mounted in a common housing. According to this design, the speaker element is directed to face the external auditory canal, and the microphone element is positioned in the housing with the receiving side directed toward the outside of the housing. Further, a plate is interposed between the speaker element and the microphone element for isolation to avoid feedback, i.e., audio coupling. Structurally, the housing houses the speaker element and the microphone element. Actually, the microphone element is adapted to receive voices directly from the user's mouth. Sound waves pass from the user's mouth through the air and the rear side of the housing to the microphone element for further transmission to communication apparatus. The microphone element is not kept inside the user's external auditory canal and blocked therein after insertion of the transducer device into the user's ear. Therefore, this design of transducer device cannot eliminate the microphone element from receiving external noises produced by surrounding workplaces, factories, and motor vehicles. During communication through the transducer device, surrounding noises are simultaneously received by the microphone element and transmitted with the user's voice to the remote communication apparatus, thereby causing the person at the remote side cannot hear the voice of the user of the transducer device clearly. Further, because the microphone element is positioned in the rear side of the housing with the receiving side of the microphone element hidden inside the housing, the voice receiving effect of the microphone element is lowered, thereby affecting the communication quality. U.S. Pat. No. 5,909,498 also discloses one alternate form in which the housing has two separated chambers for accommodating the microphone element and the speaker element, a sound passage, and separating means that separates the sound passage into two parallel sound passages for the speaker element and the microphone element respectively. According to this design, the speaker element and the microphone element are positioned in the house in a close manner. Sound waves from the speaker element will be transmitted through the housing to the microphone element, thereby causing the microphone to pick up noises and to transmit the noises to the communication apparatus at the remote side. Further, because the output port of the sound passage for microphone and the output port of the sound passage for speaker are arranged close to each other. Sound waves that pass out of the output port of the sound passage for speaker will partially pass into the output port of the sound passage for microphone and then guided by the sound passage for microphone to the microphone, causing the microphone to transmit the feedback sound waves. Thus, the voice of the person at the remote side will be transmitted to the microphone again, and the microphone will transmit the feedback noises and the voice of the user of the transducer device to the person at the remote side. At this time, the person at the remote side will hear the feedback sound. The interference of the feedback noises greatly affects the communication quality.

U.S. Pat. No. 5,363,444 and U.S. Pat. No. 5,844,984 show another two different designs. According to these two designs, the microphone is positioned on the outside of the housing for picking up the user's voice. During communication, the microphone picks up the user's voice as well as surrounding noises from surrounding workplaces, factories and motor vehicles. Because the user's voice and surrounding noises are transmitted to the remote side, the person at the remote side may be unable to hear the voice of the person at the proximity side. Further, because the microphone is provided at the outside of the housing, it is not kept close to the user's mouth. Therefore, the transmitting quality is poor.

SUMMARY OF THE INVENTION

The present invention has been accomplished under the circumstances in view. It is the main object of the present invention to provide an interference-free transmitting receiving earset, which is insertable into the user's ear at a deep distance to hold the speaker inside the external auditory canal for picking up sound waves produced by the user accurately, improving the communication quality. It is another object of the present invention to provide an interference-free transmitting receiving earset, which blocks the user's external auditory canal after insertion of the earset into the user's year, preventing interference of external noises. It is still another object of the present invention to provide an interference-free transmitting receiving earset, which eliminates interference of external sound waves and noises with the sound waves produced by the user in the external auditory canal, improving the communication quality. It is still another object of the present invention to provide an interference-free transmitting receiving earset, which enables the user to hear the voice from the speaker, preventing interference of the voice from the speaker with the microphone that receives sound waves produced by the user in the external auditory canal. It is still another object of the present invention to provide an interference-free transmitting receiving earset, which is inexpensive to manufacture. To achieve these and other objects of the present invention, the interference-free transmitting receiving earset comprises a housing; a speaker mounted in the housing; a front grille fastened to the housing and covered over the speaker, the front grille having a center tube and a plurality of through holes spaced around the center tube; a first microphone mounted inside the center tube of the front grille, the first microphone having a receiving side facing the speaker for picking up sound waves from the speaker; and a second microphone mounted inside the center tube of the front grille reversed to the first microphone, the second microphone having a receiving side facing the outside of the center tube for receiving sound waves from the user's external auditory canal.

DETAILED DESCRIPTION OF THE PREFERRED EMBODIMENT

Figure 1:
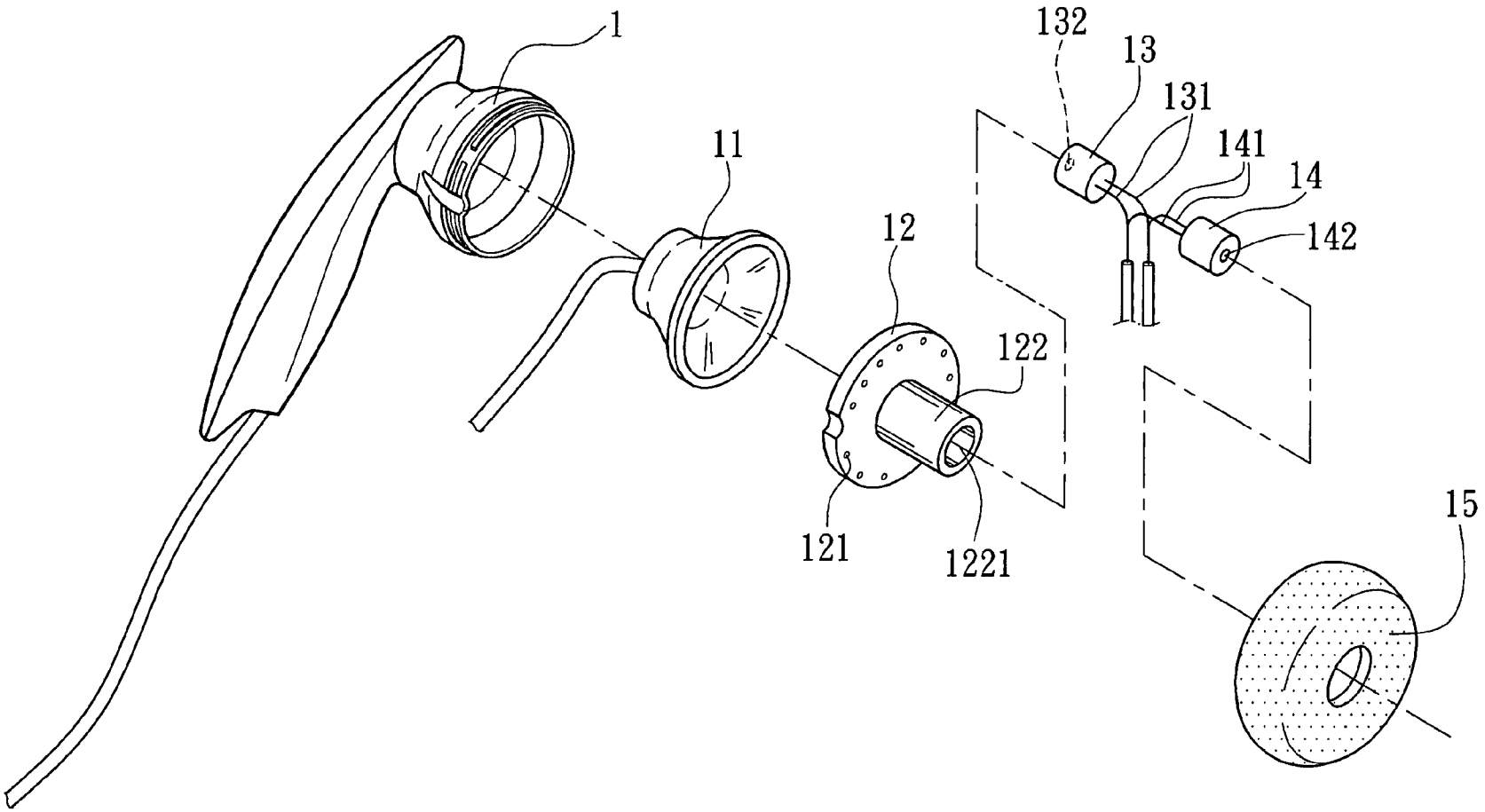
FIG. 1 is an exploded view of an interference-free transmitting receiving earset according to a first embodiment of the present invention.
Figure 2:
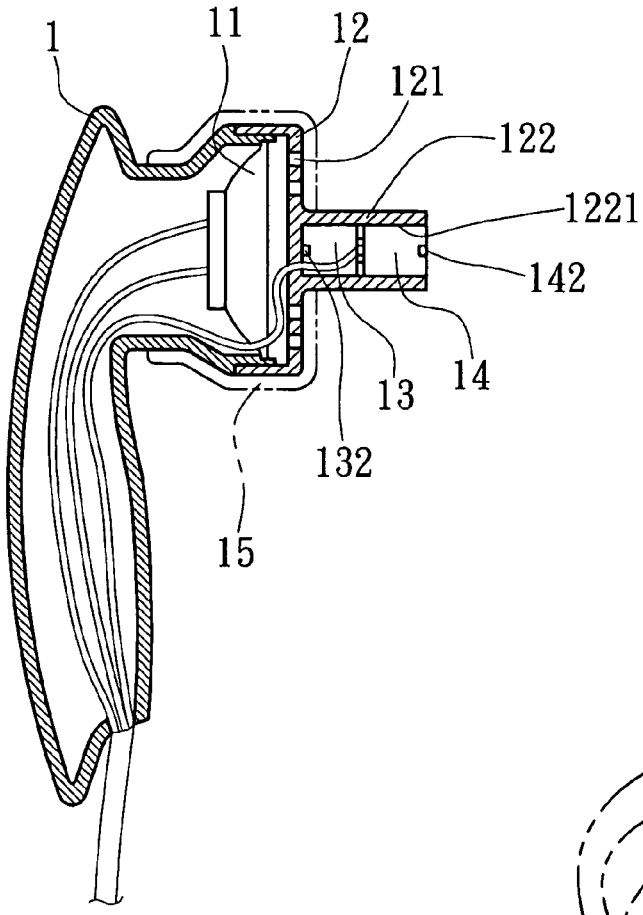
FIG. 2 is a sectional assembly view of the interference-free transmitting receiving earset according to one embodiment of the present invention.
Figure 3:
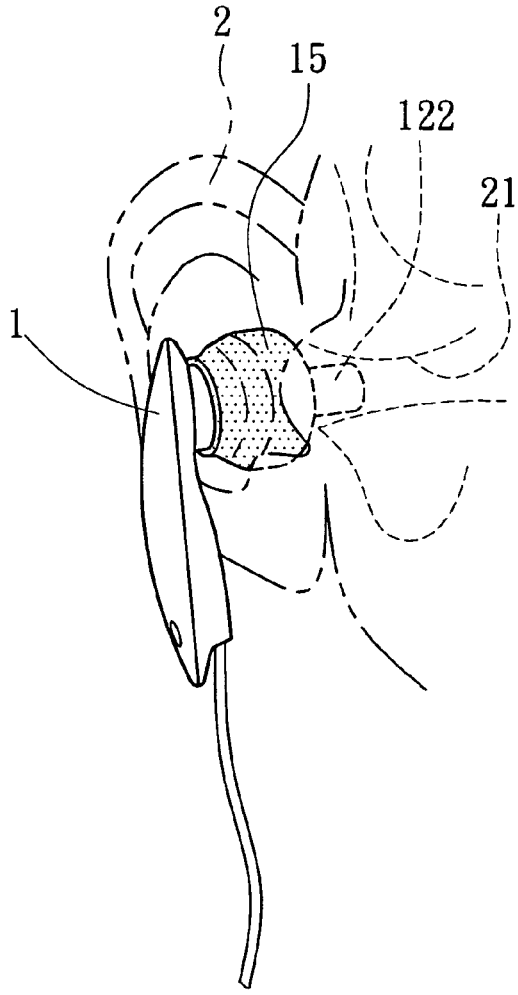
FIG. 3 is a schematic drawing showing the interference-free transmitting receiving earset of the first embodiment of the present invention inserted into the user's external auditory canal.

Referring to FIGS. 1,2,3, and 6, an interference-free transmitting receiving earset in accordance with a first embodiment of the present invention is shown comprising a housing 1, a speaker 11 mounted in the housing 1, a grille 12, which is fastened to the housing I and covered over the speaker 11 and, which has a center tube 122 and a plurality of through holes 121 spaced around the center tube 122, a set of microphones 13,14 mounted in the axial center through hole 1221 of the center tube 122 of the grille 12, and an ear cushion 15 covered on the grille 12 around the center tube 122. The microphones 13,14 have the respective electric wires 131,141 arranged together. When installed, the receiving side 132 of one microphone 13 faces the speaker 11, and the receiving side 142 of the other microphone 14 facing the outside of the center tube 122 opposite to the speaker 11. When the user inserted the earset into the external auditory canal 21 of the ear 2, the microphones 13,14 are held inside the external auditory canal 21. During communication, the microphone 14 picks up resonant sound waves from the external auditory canal 21 and transmits picked up voice signal to the external communication apparatus, for example, a cellular telephone Δ. At the same time, the microphone 13 picks up sound waves from the speaker 11 to prevent interference of sound waves with the resonant sound waves produced by the user in the external auditory canal 21. Therefore, the microphone 14 is free from the interference of the speaker 11. Further, because the speaker 11 is installed in the front side inside the housing 1, the microphones 13,14 are kept inside the external auditory canal 21 of the ear 2, and the ear cushion 15 blocks the external auditory canal 21, preventing interference of external noise with the microphones 13,14.

Figure 4:
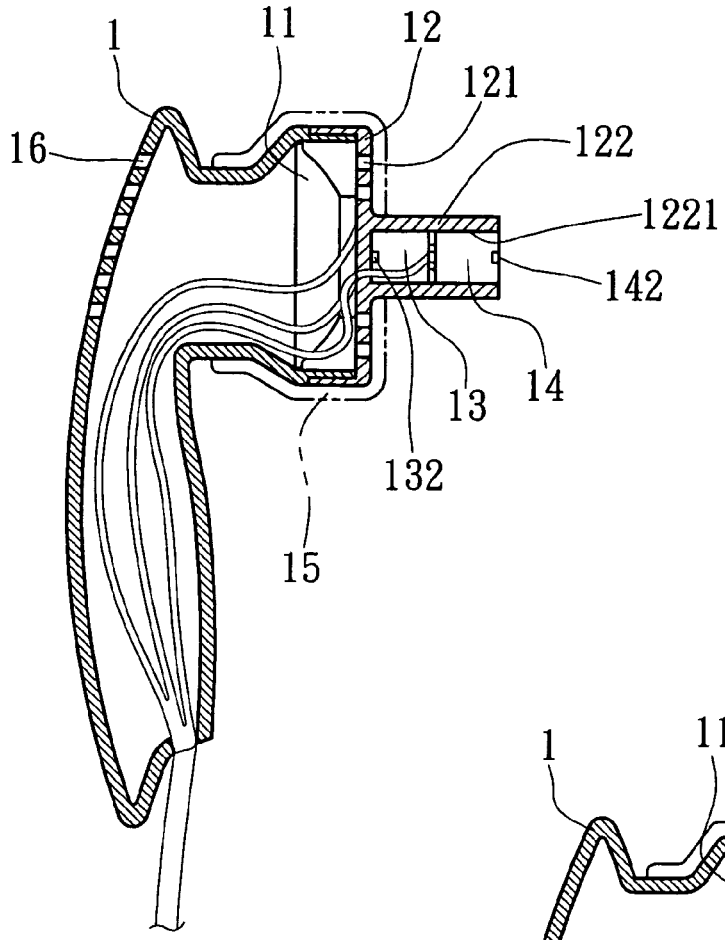
FIG. 4 is a sectional view of an interference-free transmitting receiving earset according to a second embodiment of the present invention.

FIG. 4 shows a second of the present invention. According to this embodiment, the speaker 11 is installed in the housing 1 in a backward position reversed to the position shown in FIG. 2; the housing 1 is made having a back opening (or grille) 16 facing the speaker 11 for the passing of sound waves.

Figure 5:
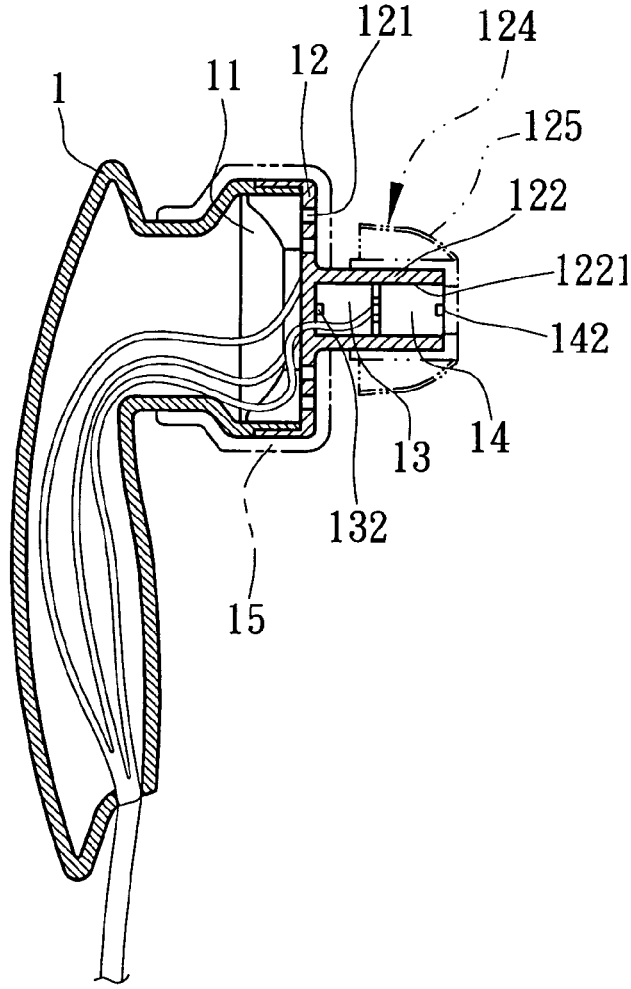
FIG. 5 is a sectional view of an interference-free transmitting receiving earset according to a third embodiment of the present invention.
Figure 6:
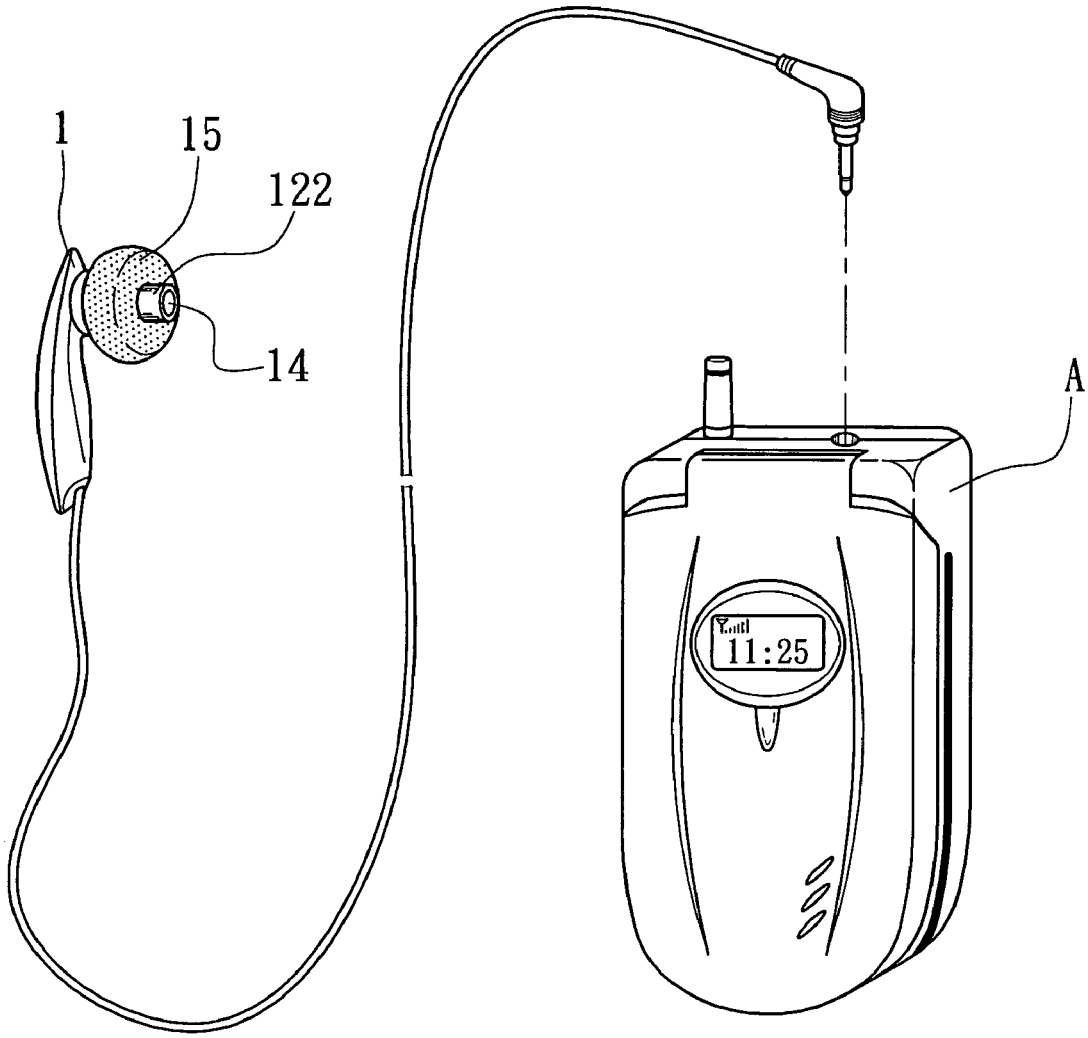
FIG. 6 shows the use of the first embodiment of the present invention with a cellular telephone.

FIG. 5 shows a third embodiment of the present invention. According to this embodiment, a silicon rubber plug 124 is fixedly fastened to the periphery of the center tube 122 of the grille 12 for insertion with the earset into the user's external auditory canal. The silicon rubber plug 124 has a skirt portion 125, which attenuates sound waves produced by the speaker 11, preventing interference of the wound waves with the microphone 14.

Figure 7:
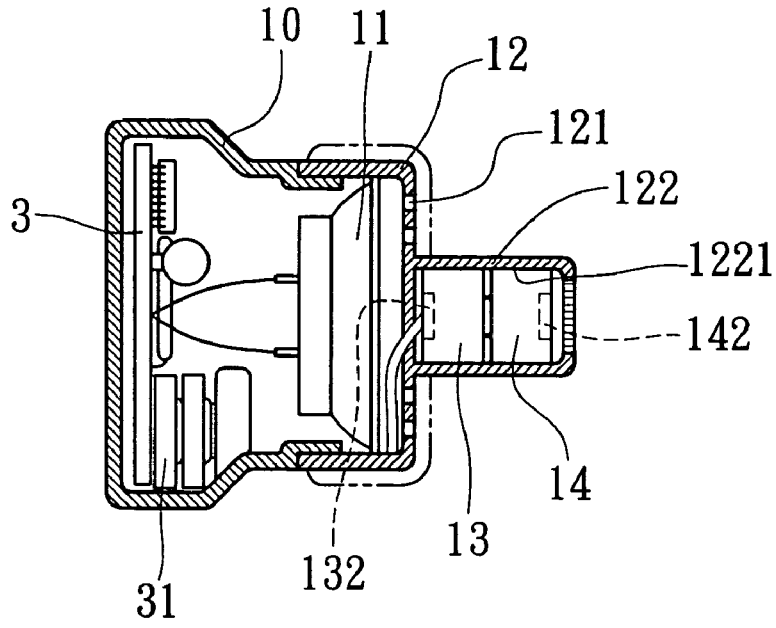
FIG. 7 is a sectional view of an interference-free transmitting receiving earset according to a fourth embodiment of the present invention.
Figure 8:
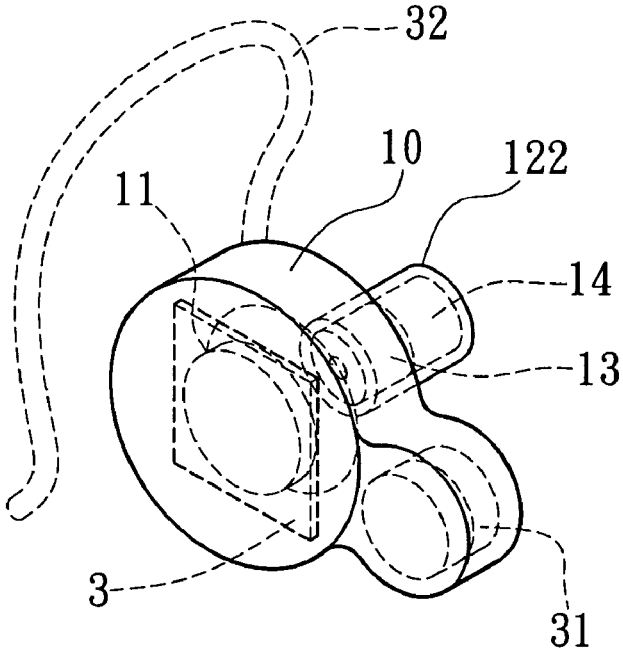
FIG. 8 is a perspective view of the interference-free transmitting receiving earset of the fourth embodiment of the present invention.

FIGS. 7 and 8 show a fourth of the present invention. According to this embodiment, speaker 11 of the earset is fastened to a hollow shell 10, which houses a wireless transmitter receiver circuit 3 and a battery 31. The battery 31 provides the necessary working voltage to the wireless transmitter receiver circuit 3. The wireless transmitter receiver circuit 3 is electrically connected to the speaker 11 and the microphones 13,14. Further, the hollow shell 10 is provided with a hook 32 for fastening the assembly to the user's ear.

Figure 9:
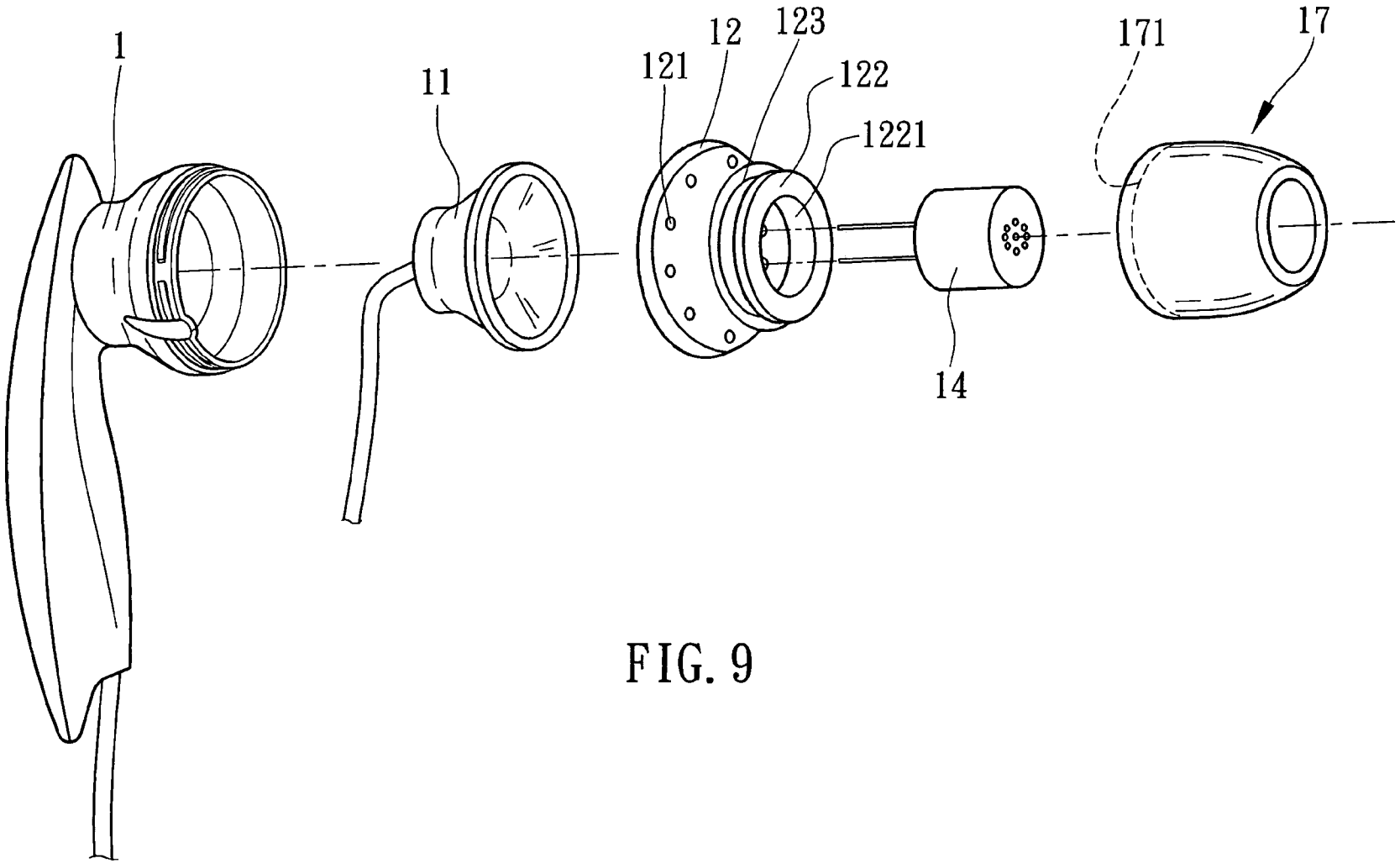
FIG. 9 is an exploded view of an interference-free transmitting receiving earset according to a fifth embodiment of the present invention.
Figure 10:
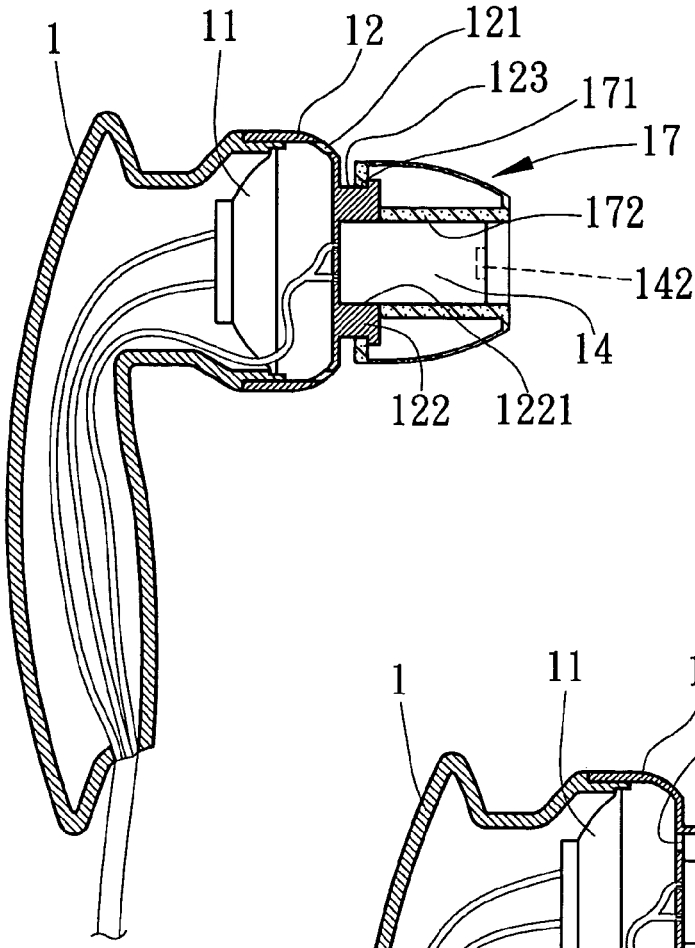
FIG. 10 is a sectional assembly view of the interference-free transmitting receiving earset according to the fifth embodiment of the present invention.

FIGS. 9 and 10 show a fifth embodiment of the present invention. According to this embodiment, the interference-free transmitting receiving earset comprises a housing 1, a speaker 11 mounted in the housing 1, a grille 12, which is fastened to the housing 1 and covered over the speaker 11 and, which has a center tube 122 and a plurality of through holes 121 spaced around the center tube 122 for the passing of sound waves from the speaker 11, a microphone 14 mounted in the axial center through hole 1221 of the center tube 122 of the grille 12, and a conical silicon rubber plug 17 fastened to the center tube 122 of the grille 12. The center tube 122 has a locating groove 123 extended around the periphery. The conical silicon rubber plug 17 has a rear retaining flange 171 fastened to the locating groove 123 of the center tube 122 of the grille 12. The conical silicon rubber plug 17 attenuates sound waves produced by the speaker 11, eliminating interference of the sound waves with the microphone 14.

Figure 11:
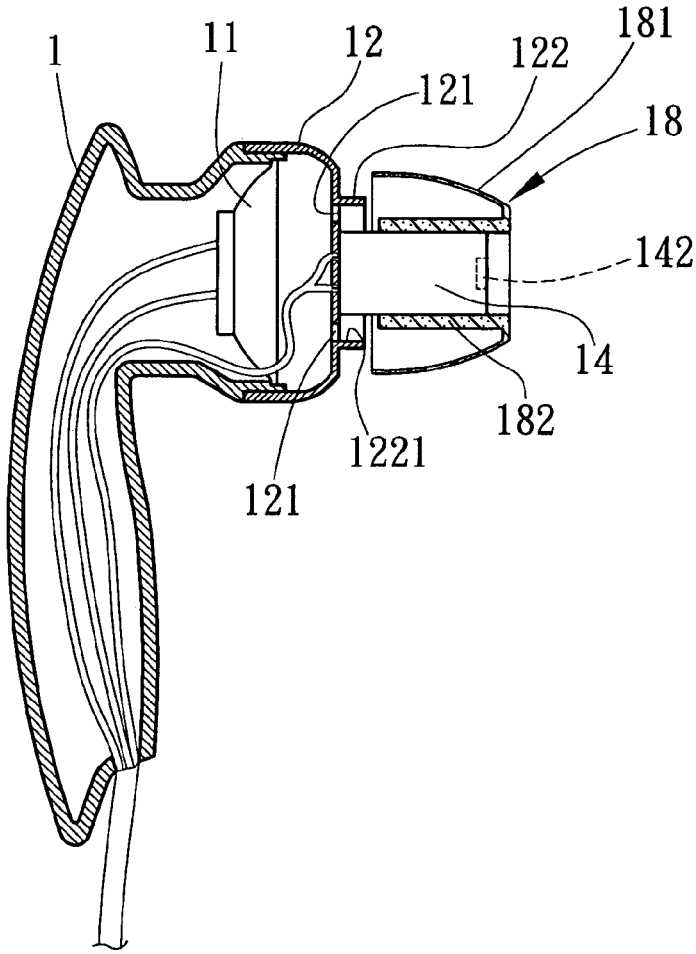
FIG. 11 is a sectional assembly view of the interference-free transmitting receiving earset according to a sixth embodiment of the present invention.

FIG. 11 shows sixth embodiment of the present invention. According to this embodiment, the interference-free transmitting receiving earset comprises a housing 1, a speaker 11 mounted in the housing 1, a grille 12, which is fastened to the housing 1 and covered over the speaker 11 and, which has a center tube 122 and a plurality of through holes 121 spaced around the center tube 122, a microphone 14 fastened to the inside of the axial center through hole 1221 of the center tube 122 of the grille 12 and partially extended out of the center tube 122, and a conical silicon rubber plug 18 fastened to the microphone 14 outside the center tube 122 of the grille 12. The conical silicon rubber plug 18 has a center mounting hole 182 extended through the front and rear sides and fastened to the periphery of the microphone 14, and a skirt-like peripheral wall 181. After insertion of the earset into the user's external auditory canal, the conical silicon rubber plug 18 attenuates sound waves produced by the speaker 11, eliminating interference of the sound waves with the microphone 14. Further, the center tube 122 may be made having a plurality of radial through holes to substitute for the through holes 121 for the passing of sound waves from the speaker 11.

Figure 12:
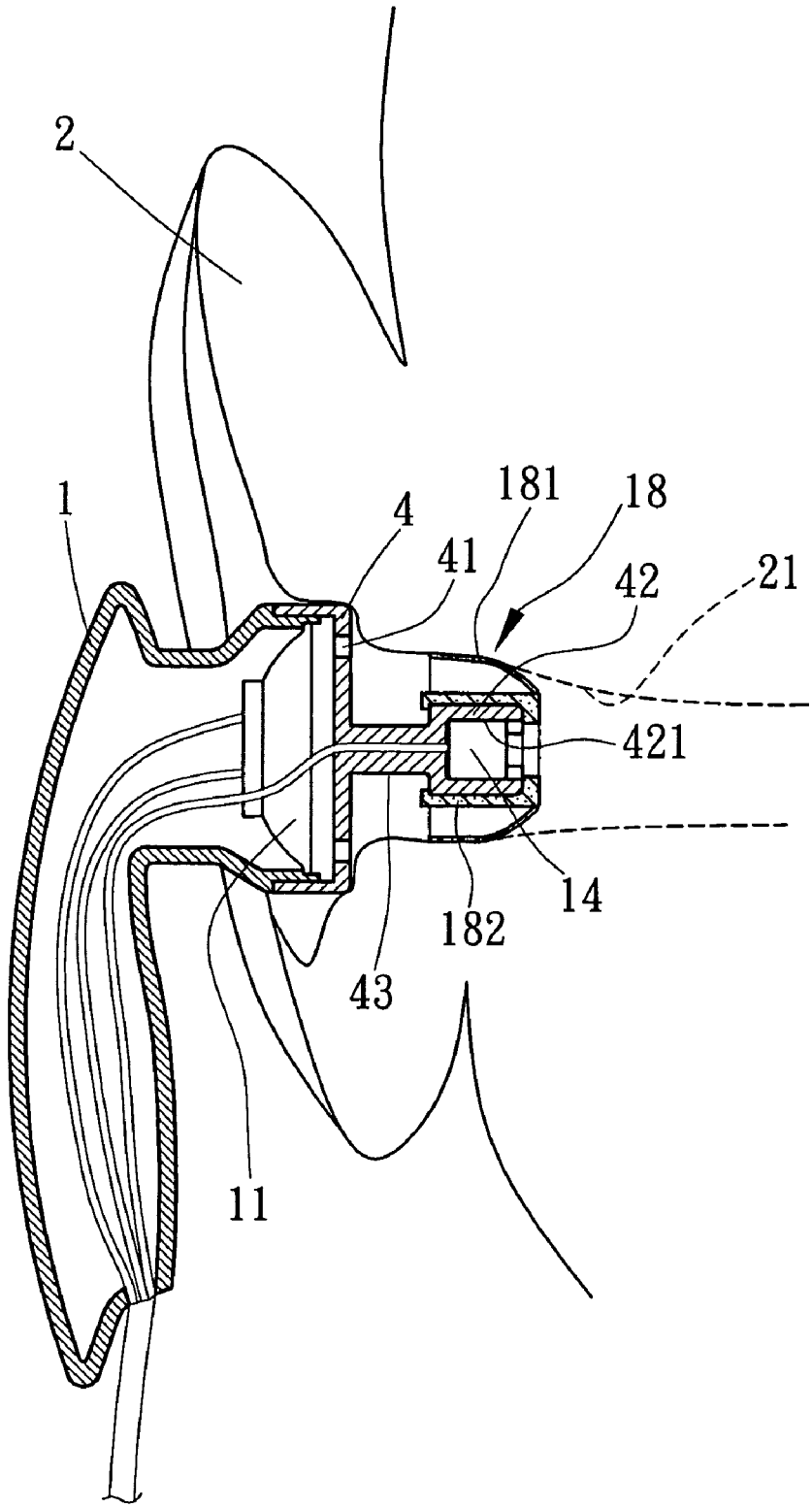
FIG. 12 is a schematic drawing an interference-free transmitting receiving earset according to a seventh embodiment of the present invention.
Figure 13:
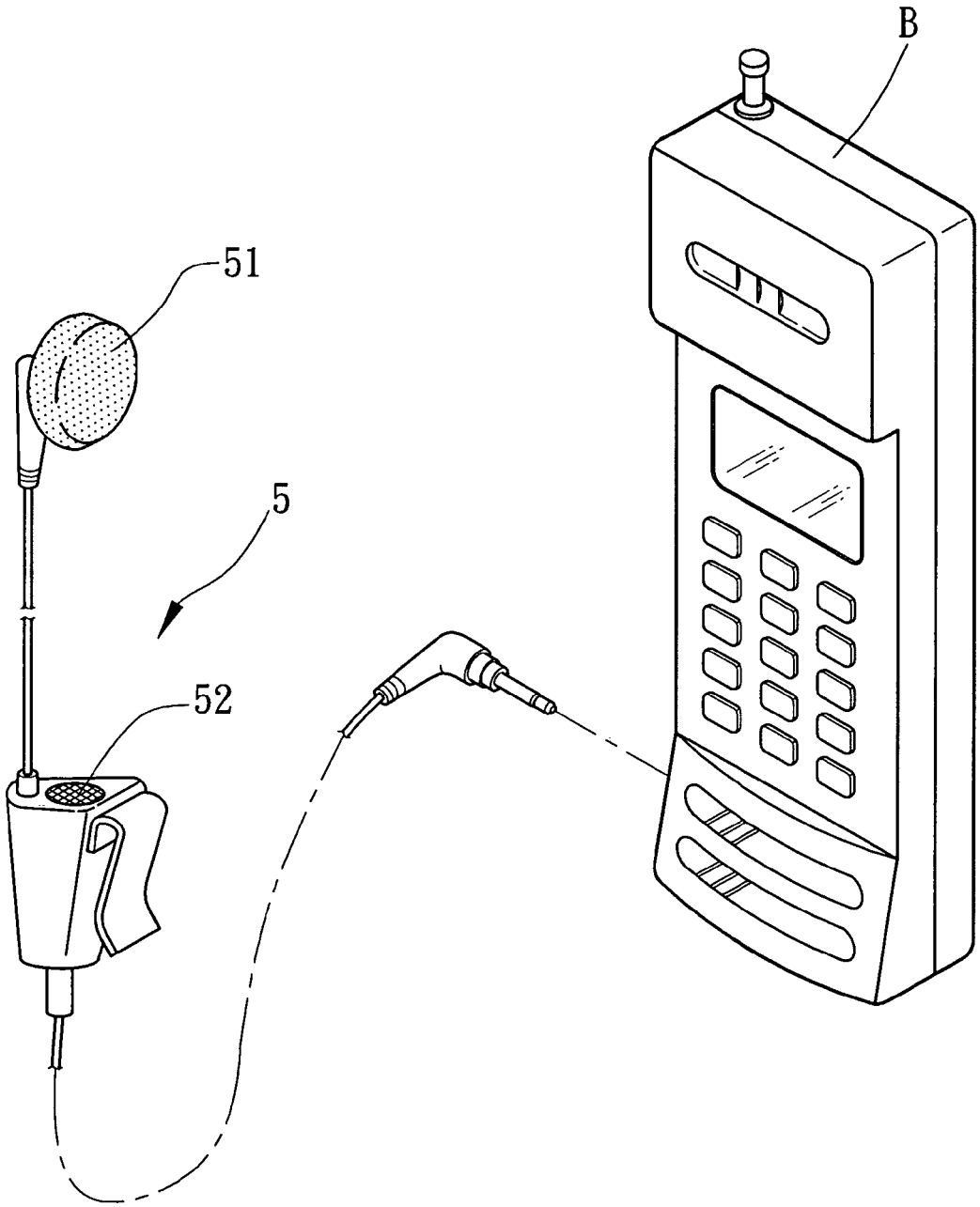
PRIOR ART FIG. 13
FIG. 13 illustrates an earset for use with a cellular telephone according to the prior art.
Figure 14:
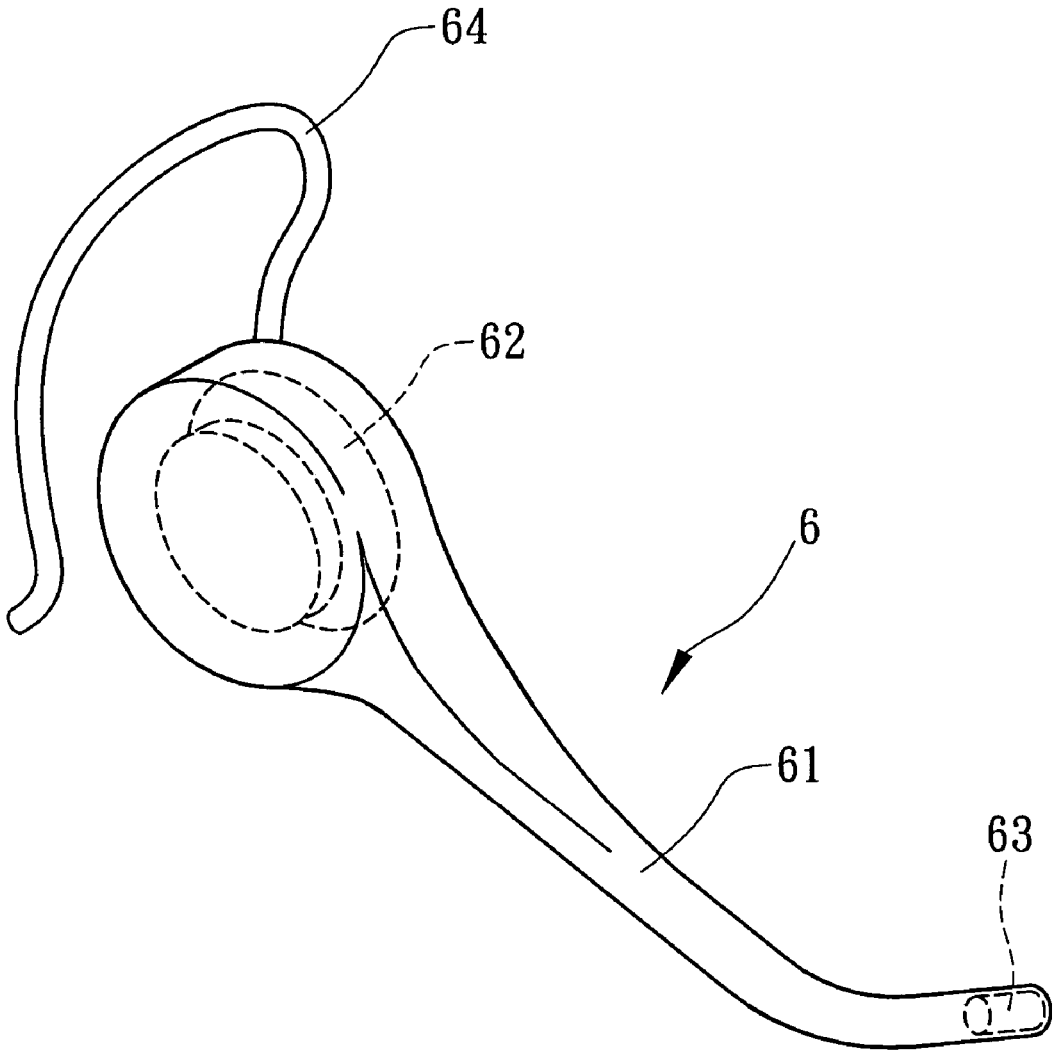
PRIOR ART FIG. 14
FIG. 14 illustrates an earset for wireless communication according to the prior art.

FIG. 12 shows a seventh embodiment of the present invention. According to this embodiment, the interference-free transmitting receiving earset comprises a housing 1, a speaker 11 mounted in the housing 1, a flexible grille 4, which is fastened to the housing 1 and covered over the speaker 11 and, which has a front extension 43, a plurality of through holes 41 spaced around the front extension 43, and a hollow cylindrical receptacle 42 at the free end of the front extension 43, a microphone 14 fastened to the inside of the center hole 421 of the hollow cylindrical receptacle 42, and a conical silicon rubber plug 18 fastened to the periphery of the hollow cylindrical receptacle 42. The conical silicon rubber plug 18 has a center mounting hole 182 extended through the front and rear sides and fastened to the periphery of the hollow cylindrical receptacle 42, a skirt-like peripheral wall 181, and a plurality of radial through holes 41 extended through the skirt-like peripheral wall 181. After insertion of the earset into the user's external auditory canal 21, the conical silicon rubber plug 18 attenuates sound waves produced by the speaker 11, eliminating interference of the sound waves with the microphone 14.

A prototype of interference-free transmitting receiving earset has been constructed with the features of FIGS. 1~12. The interference-free transmitting receiving earset functions smoothly to provide all the features discussed earlier.

Although particular embodiments of the invention have been described in detail for purposes of illustration, various modifications and enhancements may be made without departing from the spirit and scope of the invention. Accordingly, the invention is not to be limited except as by the appended claims.

What the invention claimed is:

1. A interference-free transmitting receiving earset comprising:

a housing;

a speaker mounted in said housing;

a front grille fastened to said housing and covered over said speaker, said front grille having a center tube and a plurality of through holes spaced around said center tube;

a first microphone mounted inside said center tube of said front grille, said first microphone having a receiving side facing said speaker for picking up sound waves from said speaker; and a second microphone mounted inside said center tube of said front grille reversed to said first microphone, said second microphone having a receiving side facing the outside of said center tube for receiving sound waves from the user's external auditory canal.

2. The interference-free transmitting receiving earset as claimed in claim 1, wherein said housing has a back grille in a back side thereof corresponding to said speaker.

3. The interference-free transmitting receiving earset as claimed in claim 1, further comprising a conical silicon rubber plug fastened to the periphery of said center tube of said, said conical silicon rubber plug having a skirt-like peripheral wall.

4. An interference-free transmitting receiving earset comprising:

a housing;

a speaker mounted in said housing;

a front grille fastened to said housing and covered over said speaker, said front grille having a center tube and a plurality of through holes spaced around said center tube;

a first microphone mounted inside said center tube of said front grille, said first microphone having a receiving side facing said speaker for picking up sound waves from said speaker;

a second microphone mounted inside said center tube of said front grille reversed to said first microphone, said second microphone having a receiving side facing the outside of said center tube for receiving sound waves from the user's external auditory canal;

a wireless transmitter receiver circuit module installed in said housing and electrically connected to said speaker and said second microphone; and a hook fixedly connected to the periphery of said housing for securing said housing to the user's ear.

5. An interference-free transmitting receiving earset comprising:

a housing;

a speaker mounted in said housing;

a front grille fastened to said housing and covered over said speaker, said front grille having a center tube and a plurality of through holes spaced around said center tube, said center tube having a locating groove extended around the periphery thereof;

a microphone mounted inside said center tube of said front grille, said s microphone having a receiving side facing the outside of said center tube for receiving sound waves from the user's external auditory canal; and a conical silicon rubber plug fastened to the periphery of said center tube of said, said conical silicon rubber plug having a skirt-like peripheral wall and a rear retaining flange fastened to said locating groove of said center tube of said front grille.

6. The interference-free transmitting receiving earset as claimed in claim 5, wherein said center tube has a plurality of radially extended through holes.

7. An interference-free transmitting receiving earset comprising:

a housing;

a speaker mounted in said housing;

a rubber front grille fastened to said housing and covered over said speaker, said rubber front grille having a front extension a plurality of through holes spaced around said front extension at a distance, and a hollow cylindrical receptacle formed integral with a front end of said front extension; and a microphone mounted in said hollow cylindrical receptacle for receiving sound waves from the user's external auditory canal.

8. The interference-free transmitting receiving earset as claimed in claim 7, further comprising a conical silicon rubber plug fastened to the periphery of said hollow cylindrical receptacle, said conical silicon rubber plug having a center mounting hole extended through front and rear sides thereof and fastened to the periphery of said hollow cylindrical receptacle, a skirt-like peripheral wall, and a plurality of radial through holes extended through said skirt-like peripheral wall.

* * * * *